US011299842B2

(12) United States Patent
Weng et al.

(10) Patent No.: US 11,299,842 B2
(45) Date of Patent: Apr. 12, 2022

(54) DRUM WASHING MACHINE

(71) Applicant: QINGDAO HAIER DRUM WASHING MACHINE CO., LTD., Qingdao (CN)

(72) Inventors: Zongyuan Weng, Qingdao (CN); Kai Liu, Qingdao (CN)

(73) Assignee: QINGDAO HAIER DRUM WASHING MACHINE CO., LTD., Qingdao (CN)

( * ) Notice: Subject to any disclaimer, the term of this patent is extended or adjusted under 35 U.S.C. 154(b) by 0 days.

(21) Appl. No.: 16/766,759

(22) PCT Filed: Oct. 12, 2018

(86) PCT No.: PCT/CN2018/109928

§ 371 (c)(1),
(2) Date: May 26, 2020

(87) PCT Pub. No.: WO2019/100860

PCT Pub. Date: May 31, 2019

(65) Prior Publication Data

US 2021/0010188 A1 Jan. 14, 2021

(30) Foreign Application Priority Data

Nov. 24, 2017 (CN) ..... 201711194899.5

(51) Int. Cl.
*D06F 37/26* (2006.01)
*D06F 23/02* (2006.01)
(Continued)

(52) U.S. Cl.
CPC ..... *D06F 37/266* (2013.01); *D06F 23/02* (2013.01); *D06F 37/04* (2013.01); *D06F 39/06* (2013.01); *D06F 37/02* (2013.01)

(58) Field of Classification Search
CPC ..... D06F 37/02; D06F 37/04; D06F 37/266; D06F 39/06
See application file for complete search history.

(56) References Cited

U.S. PATENT DOCUMENTS 1,586,022 A * 5/1926 Barker ..... D06F 37/32 68/58
2004/0148978 A1* 8/2004 Kim ..... D06F 37/267 68/23 A (Continued)

FOREIGN PATENT DOCUMENTS

| | | |
|---|---|---|
| CN | 101187130 | 5/2008 |
| CN | 103184670 | 7/2013 |
| CN | 106120247 | 11/2016 |

*Primary Examiner* — Joseph L. Perrin
(74) *Attorney, Agent, or Firm* — Jiwen Chen; Jacobson Holman PLLC

(57) ABSTRACT

A drum washing machine comprising: a casing (1), an outer cylinder (2) disposed in the casing (1), an inner cylinder (3) disposed in the casing (1), a door (4) provided on the casing (1), and a window gasket (5) for sealing provided between the casing (1) and the outer cylinder (2); wherein comprises: an inner cylinder front flange (32); a flow guiding structure (323) extending forward, which is provided on the inner cylinder front flange (32) and configured to introduce air into the inner cylinder (3) when entering into a spin phase; and a plurality of vents (541) opened at the window gasket (5) which are communicated with a space between the inner cylinder front flange (32) and the outer cylinder (2). When the drum washing machine enters into a spin phase to dewater, with the configuration of disposing the flow guiding structure (323) on the inner cylinder front flange (32), air in front of the inner cylinder front flange (32) could be introduced to the back side of it, and a negative pressure space could be created between the inner cylinder front flange (32) and the outer cylinder (2), and additionally, air (Continued)

around the window gasket (5) could enter into the space between the inner cylinder front flange (32) and the outer cylinder (2) by the vent (541) to create a high volume airflow circulating around the inner surface of the window gasket 5 to dry it quickly, which could speed up drying time, prevent the breeding of bacteria and eliminate the odor.

8 Claims, 3 Drawing Sheets

(51) Int. Cl.

| | |
|---|---|
| ***D06F 37/04*** | (2006.01) |
| ***D06F 39/06*** | (2006.01) |
| ***D06F 37/02*** | (2006.01) |

(56) References Cited

U.S. PATENT DOCUMENTS

| | | | | |
|---|---|---|---|---|
| 2006/0174663 | A1* | 8/2006 | Cimetta | D06F 37/266 68/3 R |
| 2008/0256720 | A1* | 10/2008 | Park | D06F 39/008 8/149.3 |
| 2009/0165505 | A1* | 7/2009 | Bobed | D06F 37/266 68/139 |
| 2013/0199250 | A1* | 8/2013 | Doh | D06F 39/008 68/5 C |
| 2013/0291395 | A1* | 11/2013 | Doh | D06F 58/24 34/468 |
| 2014/0060122 | A1* | 3/2014 | Buso | D06F 39/14 68/18 F |

* cited by examiner

DRUM WASHING MACHINE

This is a U.S. national stage application of PCT Application No. PCT/CN2018/109928 under 35 U.S.C. 371, filed Oct. 12, 2018 in Chinese, claiming priority of Chinese Application No. 201711194899.5, filed Nov. 24, 2017, all of which are hereby incorporated by reference.

TECHNICAL FIELD

The invention belongs to the technical field of washing machine, and in particular relates to a drum washing machine.

BACKGROUND

The user of a drum washing machine should keep the door closed after use by which to save indoor space and maintain a neat appearance of the appliance, but a small amount of residual water will be left on a window gasket of the washing machine door immediately after washing, which is mixed with greases, sebum, dust and detergent. The closed door will form a relatively sealed space inside the washing machine where the residual water is volatilized at a very low speed and the window gasket is still damp for a long time further resulting in odor, breeding of bacteria and secondary pollution of subsequent laundry that could undermine use experience and endanger user health.

Typical solutions for removing the residual water on the window gasket includes: 1. a plurality of drain holes are formed at the lowest of the circumference of the window gasket (namely at a six o'clock position) which are communicated with the inner space of an outer cylinder of the washing machine, by which the residual water could be collected by gravity and introduced to the outer cylinder which is connected to a drainage device through soft pipes thereby being discharged; 2. a plurality of drain holes are formed at the lowest of the circumference of the window gasket (namely at a six o'clock position) which are communicated with a drainage device via an additional pipe, by which the residual water could be collected by gravity and introduced to the drainage device thereby being discharged. These structures could discharge most of the residual water but there will be water on the surface of the window gasket which could not be removed properly. Under the circumstance of the door is closed and a relatively sealed space is formed, the wet window gasket also results in odor and breeding of bacteria and secondary pollution of subsequent laundry which will endanger user health.

SUMMARY OF THE INVENTION

To address the above-mentioned problems, a drum washing machine is provided in which an air flow will be introduced to the surface of the window gasket during a spin cycle to dry the window gasket surface quickly, so as to reduce the possibilities of breeding of bacteria and odor.

To achieve the above technical purpose, the present invention is implemented by the following technical solutions.

A drum washing machine comprising: a casing, an outer cylinder disposed in the casing, an inner cylinder disposed in the casing, a door provided on the casing, and a window gasket for sealing provided between the casing and the outer cylinder; the drum washing machine comprises: an inner cylinder front flange; a flow guiding structure extending forward, which is provided on the inner cylinder front flange and configured to introduce air into the inner cylinder when entering into a spin phase; and a plurality of vents opened at the window gasket which are communicated with a space between the inner cylinder front flange and the outer cylinder.

Further the drum washing machine comprises one or more guiding holes opened on a windward surface of the flow guiding structure when entering into a spin phase.

Further the flow guiding structure comprises: a first end surface and a second end surface which protrude forward and are inclined toward each other, and the projection of an intersection line between the first end surface and the second end surface onto the inner cylinder front flange coincides a radius of the inner cylinder front flange.

Further the flow guiding structure comprises: a first end surface and a second end surface which protrude forward and are inclined toward each other, and an intersection line between the first end surface and the second end surface lies in a radial direction of the inner cylinder.

Further the drum washing machine comprises a laundry access formed on a front panel of the casing where the door capable of be opened is installed; the window gasket comprises: an inner lip sealing at the outer cylinder, a fold extending forward from the inner lip, a rib extending inward from the inner lip along a radial direction, at which a vent is opened and a cavity formed between the rib and the fold.

Further the window gasket comprises: a blocking portion extending rearward which is provided at an inner end of the rib and is configured to prevent air from flowing into via a gap between the rib and the inner cylinder front flange.

Further the inner cylinder front flange comprises: an inner cylinder edge extending toward the laundry access, an outer flange provided at a front end of the inner cylinder edge; and a rear part of the blocking portion is located at the outside of the outer flange.

Further the blocking portion has a curving surface extending along a rearward-backward direction from the rib.

Further the fold has a first inclined portion extending forward from the inner lip and a second inclined portion which is bent and extends from a front end of the first inclined portion toward the inner end of the rib.

Further a guiding portion extending along a forward-outward direction which is provided at the rib and is in parallel with the second inclined portion.

Further the window gasket comprises an outer lip sealing at the laundry access and a connecting portion between the outer lip and the fold.

Further when entering into a spin phase, the inner cylinder rotates at a high speed, air is introduced to the inside of the inner cylinder from a space between the inner cylinder front flange and the outer cylinder where negative pressure is created and air around the window gasket enters into the space between the inner cylinder front flange and the outer cylinder by the vent to create a volume of air circulating around the inner surface of the window gasket to dry it.

Further when entering into a spin phase, an air circulation among the flow guiding structure, the window gasket and the vent is formed.

When the drum washing machine enters into a spin phase to dewater, the inner cylinder will rotate at a very high speed. With the configuration of disposing the flow guiding structure on the inner cylinder front flange and opening the vent on the window gasket, air in front of the inner cylinder front flange could be introduced to the back side of it, namely to the inside of the inner cylinder, and a negative pressure space could be created between the inner cylinder front flange and the outer cylinder, and additionally, air around the window gasket could enter into the space between the inner cylinder front flange and the outer cylinder by the vent to create a high volume airflow circulating around the inner surface of the window gasket to dry it quickly. The air circulation among the flow guiding structure, the window gasket and the vent could speed up drying time, prevent the breeding of bacteria and eliminate the odor.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification.

In the description of the present invention, it should be noted that the orientation or positional relationship defined by the terms "inner", "upper", "lower", "left", "right", etc. is based on the positional relationship shown in one of more of the drawings in an effort to provide a concise description, which is not to be construed that the device or the elements should have specified orientation or be operated along a specified orientation. Moreover, it should be understood that the terms "first", "second" and "third" are used for descriptive purposes only and are not to be construed as indicating or implying relative importance.

Figure 1:
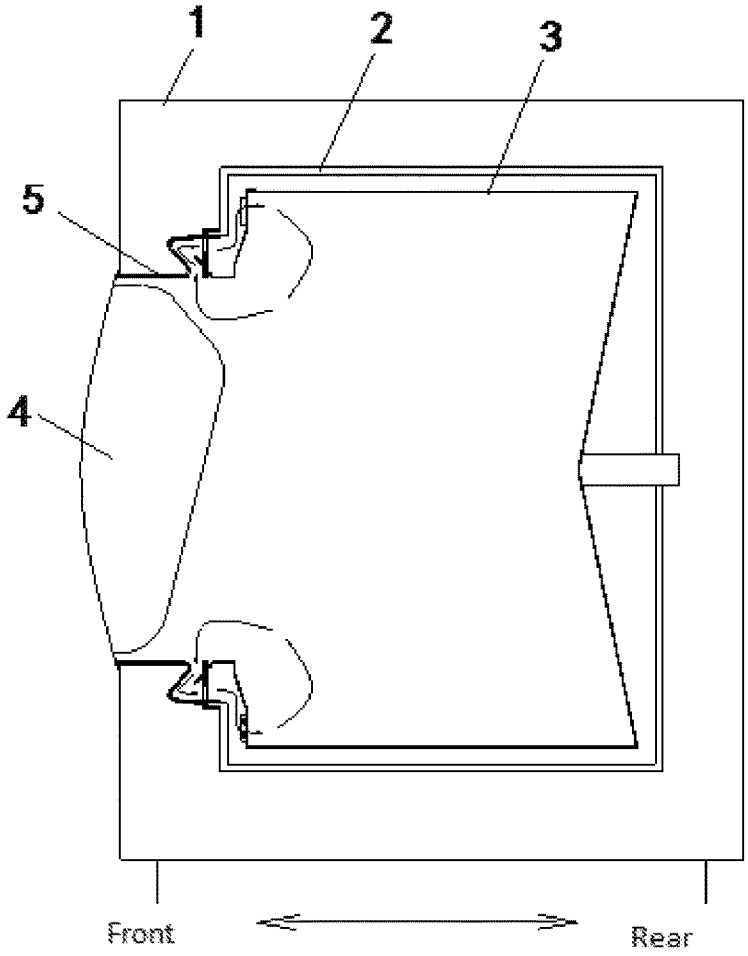
FIG. 1 is a perspective view of a drum washing machine according to one aspect of the present invention.
Figure 2:
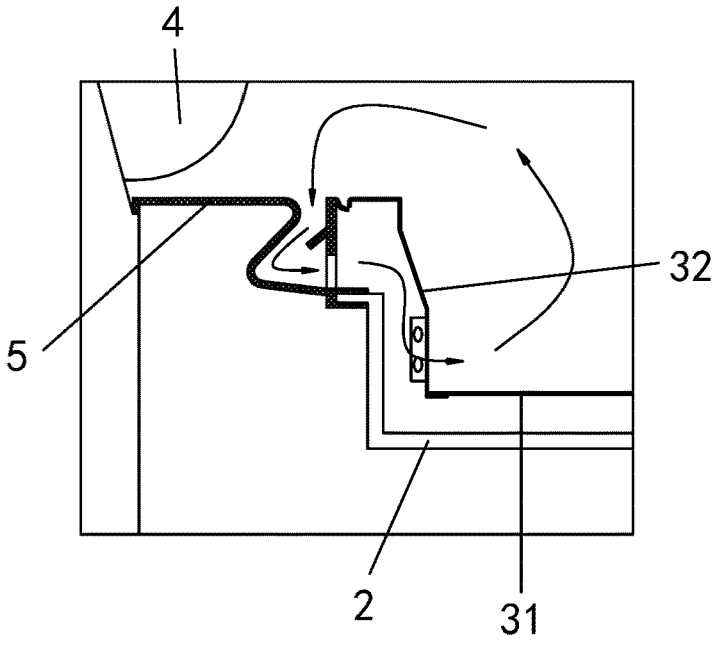
FIG. 2 is a partial enlarged view of FIG. 1.
Figure 3:
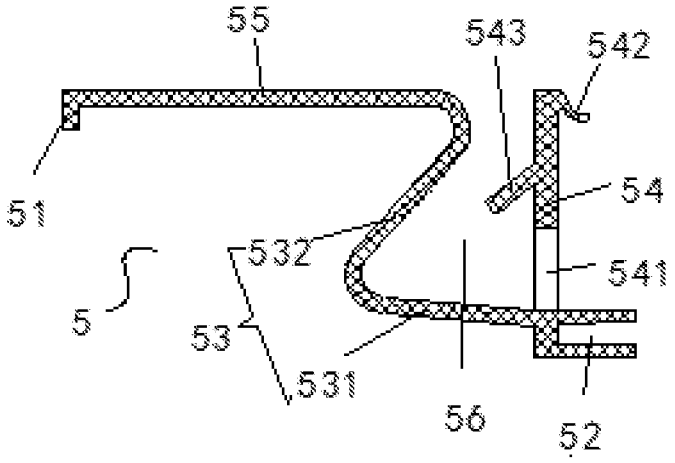
FIG. 3 is a partial enlarged view of a window gasket shown in FIG. 2.
Figure 4:
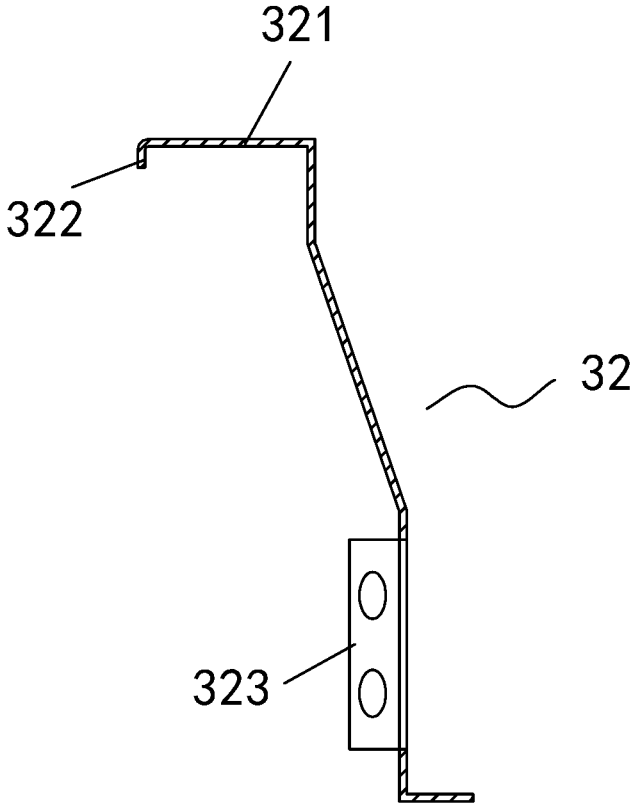
FIG. 4 is a partial enlarged view of an inner cylinder front flange shown in FIG. 2.
Figure 5:
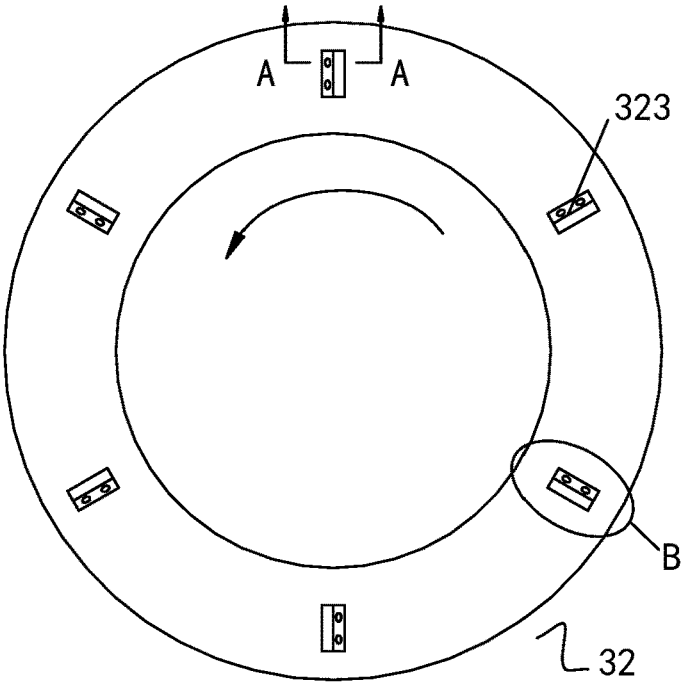
FIG. 5 is a main view of the inner cylinder front flange.

A drum washing machine according to the present invention is shown in FIGS. 1 to 7. As shown in FIG. 1, the drum washing machine comprises a casing 1 within which an outer cylinder 2 and an inner cylinder 3 are disposed. Both of a laundry access and a door 4 configured to open or close the laundry access are provided on a front panel of the casing 1. A window gasket 5 for sealing is provided between the laundry access and the outer cylinder 2. The door 4, together with the window gasket 5, seals the laundry access as being closed. As shown in FIG. 2, the inner cylinder 3 has a cylindrical inner cylinder body 31 and an inner cylinder front flange 32 provided at a front end of the inner cylinder body 31. A plurality of vents 541 are opened on the window gasket 5 thereby allowing air to flow through the inner surface of the window gasket 5. The airflow passing through the inner surface of the window gasket 5 backwardly enters into a space between the outer cylinder 2 and the inner cylinder 3 which is particularly enclosed by the inner cylinder front flange 32 and the outer cylinder 2 through the vent 541. As shown in FIG. 4 and FIG. 5, the inner cylinder front flange 32 is provided with one or more flow guiding structures 323 which extend forward and protrude from the inner cylinder front flange 32. The flow guiding structure 323 is configured to introduce air between the inner cylinder front flange 32 and the outer cylinder 2 to move to the inside of the inner cylinder 3; that is to say to introduce air in front of the inner cylinder front flange 32 to the back side of the inner cylinder front flange 32.

When the drum washing machine enters into a spin phase to dewater, the inner cylinder 3 will rotate at a very high speed. With the configuration of disposing the flow guiding structure 323 on the inner cylinder front flange 32 and opening the vent 541 on the window gasket 5, air in front of the inner cylinder front flange 32 could be introduced to the back side of it, namely to the inside of the inner cylinder 3, and a negative pressure space could be created between the inner cylinder front flange 32 and the outer cylinder 2, and additionally, air around the window gasket 5 could enter into the space between the inner cylinder front flange 32 and the outer cylinder 2 through the vent 541 to create a high volume airflow circulating around the inner surface of the window gasket 5 to dry it quickly. The air circulation among the flow guiding structure 323, the window gasket 5 and the vent 541 could speed up drying time, prevent the breeding of bacteria and eliminate the odor.

Figure 7:
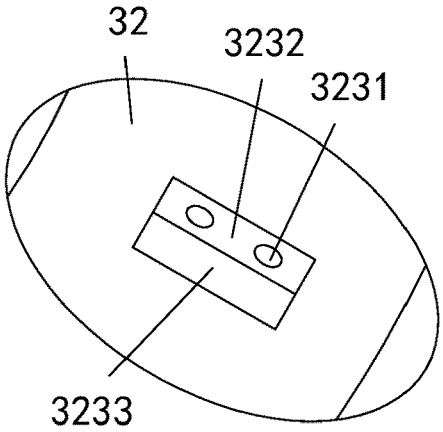
FIG. 7 is an enlarged view of an area B of the FIG. 5.

Referring to FIG. 2 and FIG. 7, one or more guiding hole 3231 are opened on a windward surface of the flow guiding structure 323, with which when the drum washing machine enters into a spin phase and the inner cylinder 3 rotates at a high speed wind resistance on the windward surface is relatively enforced so as to increase air flowing into the inner cylinder 3 through the guiding hole 3231 to be favorable for creating the negative pressure space between the inner cylinder front flange 32 and the outer cylinder 2. Preferably, a plurality of flow guiding structures 323 are evenly disposed circumferentially around the inner cylinder front flange 32 on one side close to the inner cylinder body 31. Due to the fact that the farther a point away from the axis the greater the linear velocity when the inner cylinder 3 rotates, the arrangement of the flow guiding structures 323 on the side of the inner cylinder front flange 32 close to the inner cylinder body 31 could increase the velocity at the flow guiding structure, so that it is beneficial in speeding up the airflow through the flow guiding structures 323, the overall air circulation and the drying process. Additionally, both of the evenly distribution of the flow guiding structures 323 on the circumference of the inner cylinder front flange 32 and the vents 541 are advantageous for creating an evenly distributed airflow on the inner surface of the window gasket 5 so as to carry away the moisture thereon and further speed up the drying process.

Figure 6:
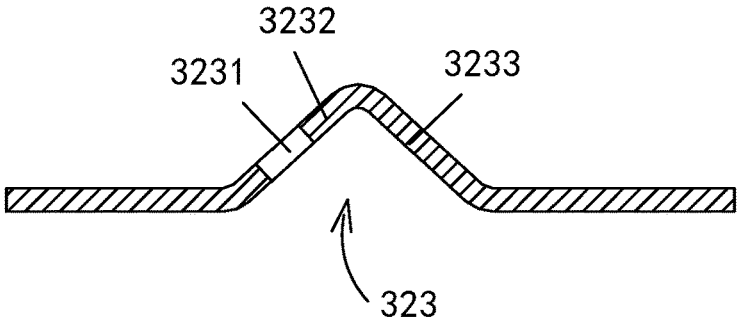
FIG. 6 is an enlarged cross-section view of the FIG. 5 along line A-A.

As shown in FIG. 6, a flow guiding structure 323 has a first end surface 3232 and a second end surface 3233 which protrude forward and are inclined toward each other. The projection of an intersection line between the first end surface 3232 and the second end surface 3233 onto the inner cylinder front flange 32 is coincides a radius of the inner cylinder front flange 32. The first end surface 3232 and the second end surface 3233 protrude forward from the inner cylinder front flange 32, that is to say enter into the space between the outer cylinder 2 and the inner cylinder front flange 32. The inner cylinder 3 is typically arranged to rotate counterclockwise in the spin phase and the first end surface 3232 serves as the windward surface of the flow guiding structure 323. The guiding hole 3231 could be opened on the first end surface 3232 to allow air to enter into the inner cylinder 3. The inverted V-shaped connection of the inclined first end surface 3232 and second end surface 3233 could ensure air between the outer cylinder 2 and the inner cylinder front flange 32 enter into the inner cylinder 3 while controlling wind resistance thereon at an acceptable level.

Referring to FIG. 3, a window gasket 5 preferably includes an outer lip 51 sealing at the laundry access, an inner lip 52 sealing at the outer cylinder 2, a fold 53 extending forward from the inner lip 52, a rib 54 extending inward from the inner lip 52 along a radial direction and a connecting portion 55 between the outer lip 51 and the fold 53 which extends along an axis direction. A cavity 56 is formed between the rib 54 and the fold 53, within which the residual water on the window gasket 5 mainly remain. The vent 541 is preferably opened at the rib 54. With these configurations, when the drum washing machine enters into a spin phase to dewater and the inner cylinder 3 rotates at a high speed, for one aspect, the first end surface 3232 is the windward surface and the air between the inner cylinder front flange 32 and the outer cylinder 2 enters into the inner cylinder 3 via the guiding hole 3231 on the first end surface 3232 to create negative pressure in the space between the inner cylinder front flange 32 and the outer cylinder 2, and for another aspect air within the cavity 56 also enters into the space between the inner cylinder front flange 32 and the outer cylinder 2 via the vent 541 and a negative pressure environment also be created within the cavity 56 as the air flowing out; air also could enter into the cavity 56 through an inlet of the cavity which is formed between the rib 54 and the fold 53 so that an air circulation path could be formed among the flow guiding structure 323, the cavity 56 and the vent 541 to dry the residual water on inner wall of the cavity 56.

As shown in FIG. 3, a blocking portion 542 extending rearward is provided at an inner end of the rib 54, which is configured to prevent air from flowing into the space between the inner cylinder front flange 32 and the outer cylinder 2 via a gap between the rib 54 and the inner cylinder front flange 32, to ensure that the circulated air could flow through the inner surface of the window gasket 5 and enter into the space between the inner cylinder front flange 32 and the outer cylinder 2 merely via the vent 541 and the volume of air flowing through the window gasket 5 is sufficient to dry the window gasket 5 at a short time period.

As shown in FIG. 4, the inner cylinder front flange 32 is preferably provided with an inner cylinder edge 321 extending toward the laundry access, and an outer flange 322 is provided at a front end of the inner cylinder edge 321 and a rear part of the blocking portion 542 is located at the outside of the outer flange 322. Since the inner cylinder 3 is a rotating component but the window gasket 5 is a fixed component, the blocking portion 542 and the outer flange 322 could not be in close contact with each other. With the arrangement of the rearward extending blocking portion 542 with the rear portion located outside of the outer flange 322, the gap between the rib 54 and the inner cylinder front flange 32 could be blocked to prevent air from flowing through. An inner end surface of the rib 54 is in alignment with the inner cylinder edge 321. Preferably, the blocking portion 542 has a curving surface which is bent along a rearward-backward direction from the inner end of the rib 54 so as to block air while keeping the blocking portion being apart from the outer flange 322.

As shown in FIG. 3, the fold 53 has a first inclined portion 531 extending forward from the inner lip 52 and a second inclined portion 532 which is bent and extends from an front end of the first inclined portion 531 toward the inner end of the rib 54, thereby enclosing the cavity 56 of small top and big bottom within which the residual water may not be volatilized quickly. Hence, a guiding portion 543 extending along a forward-outward direction is provided at the rib 54, which is in parallel with the second inclined portion 532, specifically the forward-outward extending guiding portion 543 is disposed at a position of the rib 54 corresponding to at the entrance of the cavity 56 and has the same inclination direction as the fold 53 at the entrance of the cavity 56, and thereby allowing air to enter into the cavity 56 along an inner wall of the second inclined portion 532 in parallel. The direction of the airflow will be adjusted as flowing at the intersection of the second inclined portion 532 and the first inclined portion 531 and flow to the vent 541 along the first inclined portion 531, and the airflow along the inner wall of the cavity 56 will further improve drying effect on the window gasket 5.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A drum washing machine comprising:

a casing, an outer cylinder disposed in the casing, an inner cylinder disposed in the casing and including a front flange, a door provided on the casing, a window gasket for sealing provided between the casing and the outer cylinder;

a flow guiding structure extending forward, which is provided on the inner cylinder front flange and configured to introduce air into the inner cylinder when entering into a spin phase; and a plurality of vents opened at the window gasket which are communicated with a space between the inner cylinder front flange and the outer cylinder;

wherein the flow guiding structure comprises:

a first end surface and a second end surface which protrude forward and are inclined toward each other, and the projection of an intersection line between the first end surface and the second end surface onto the front flange coincides a radius of the front flange.

2. The drum washing machine of claim 1, wherein the drum washing machine comprises:

one or more guiding holes opened on a windward surface of the flow guiding structure when entering into a spin phase.

3. The drum washing machine according to claim 1, wherein the drum washing machine comprises:

a laundry access formed on a front panel of the casing where the door capable of be opened is installed;

the window gasket comprises:

an inner lip sealing at the outer cylinder, a fold extending forward from the inner lip, a rib extending inward from the inner lip along a radial direction, at which a vent is opened, and a cavity formed between the rib and the fold.

4. The drum washing machine according to claim 3, wherein the window gasket comprises:

a blocking portion extending rearward which is provided at an inner end of the rib and is configured to prevent air from flowing into via a gap between the rib and the front flange.

5. The drum washing machine according to claim 4, wherein the inner cylinder front flange comprises:

an inner cylinder edge extending toward the laundry access, an outer flange provided at a front end of the inner cylinder edge; and a rear part of the blocking portion is located at the outside of the outer flange.

6. The drum washing machine according to claim 5, wherein the blocking portion has a curving surface extending along a rearward-backward direction from the rib.

7. The drum washing machine according to claim 3, wherein the fold has a first inclined portion extending forward from the inner lip and a second inclined portion which is bent and extends from a front end of the first inclined portion toward the inner end of the rib.

8. The drum washing machine according to claim 7, wherein the drum washing machine comprises:

a guiding portion extending along a forward-outward direction which is provided at the rib and is in parallel with the second inclined portion.

* * * * *